US009534607B2

(12) United States Patent
Ikeguchi et al.

(10) Patent No.: US 9,534,607 B2
(45) Date of Patent: Jan. 3, 2017

(54) COMPRESSOR OF USE IN GAS TURBINE ENGINE

(75) Inventors: Takuya Ikeguchi, Kobe (JP); Koji Terauchi, Kobe (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 1019 days.

(21) Appl. No.: 13/637,396

(22) PCT Filed: Mar. 2, 2011

(86) PCT No.: PCT/JP2011/054689

§ 371 (c)(1),
(2), (4) Date: Oct. 26, 2012

(87) PCT Pub. No.: WO2011/118344

PCT Pub. Date: Sep. 29, 2011

(65) Prior Publication Data

US 2013/0202422 A1 Aug. 8, 2013

(30) Foreign Application Priority Data

Mar. 26, 2010 (JP) ..... 2010-071890

(51) Int. Cl.
*F04D 29/08* (2006.01)
*F04D 19/00* (2006.01)
(Continued)

(52) U.S. Cl.
CPC ..... *F04D 19/00* (2013.01); *F01D 25/24* (2013.01); *F04D 29/023* (2013.01);
(Continued)

(58) Field of Classification Search
CPC ..... F04D 29/644; F04D 29/524; F04D 29/526
See application file for complete search history.

(56) References Cited

U.S. PATENT DOCUMENTS 3,864,056 A * 2/1975 Gabriel ..... F01D 5/08 415/116
4,543,039 A * 9/1985 Ruis ..... F01D 9/041 415/173.1
(Continued)

FOREIGN PATENT DOCUMENTS

DE 3341871 A1 5/1985
EP 1843010 A2 10/2007
(Continued)

OTHER PUBLICATIONS

An Office Action issued by the Canadian Intellectual Property Office on Nov. 7, 2013, which corresponds to Canadian Patent Application No. 2,794,474 and is related to U.S. Appl. No. 13/637,396.
(Continued)

*Primary Examiner* — Craig Kim
*Assistant Examiner* — Jason Fountain
(74) *Attorney, Agent, or Firm* — Studebaker & Brackett PC

(57) ABSTRACT

Provided is a compressor for use in a gas turbine engine, capable of preventing a creation of rust on an inner surface of the compressor casing, without complicating assembling process. The casing 15 of the compressor 3 accommodates rotor and stator blade wheels 13 and 17. The stator blade wheels 17 are supported on the inner surface of the casing 15 through outer flanges 30 thereof. Seal rings 52 are provided at inner surface portions of the casing 15 opposing the radially outward ends of the rotor blade wheels 13. The inner surface of the casing 15 is covered by the seal rings 52 and the outer flanges 30 of the stator blade wheels 17.

5 Claims, 4 Drawing Sheets

(51) Int. Cl.

| | |
|---|---|
| ***F01D 25/24*** | (2006.01) |
| ***F04D 29/02*** | (2006.01) |
| ***F04D 29/52*** | (2006.01) |
| ***F04D 29/54*** | (2006.01) |
| ***F04D 29/64*** | (2006.01) |

(52) U.S. Cl.
CPC ..... *F04D 29/083* (2013.01); *F04D 29/526* (2013.01); *F04D 29/542* (2013.01); *F04D 29/644* (2013.01); *F05D 2260/95* (2013.01)

(56) References Cited

U.S. PATENT DOCUMENTS

| | | | | |
|---|---|---|---|---|
| 5,562,408 | A * | 10/1996 | Proctor | F01D 11/24 415/173.1 |
| 7,011,493 | B2 * | 3/2006 | Marchi | F01D 9/04 415/116 |
| 2001/0048876 | A1 | 12/2001 | Humhauser | |
| 2002/0192074 | A1 * | 12/2002 | Turnquist | F01D 11/122 415/173.3 |
| 2009/0092498 | A1 | 4/2009 | Jabado et al. | |
| 2010/0034645 | A1 | 2/2010 | Mulcaire et al. | |

FOREIGN PATENT DOCUMENTS

| | | | |
|---|---|---|---|
| JP | 59-113299 | | 6/1984 |
| JP | 2002-004806 | A | 1/2002 |
| JP | 2009-523939 | A | 6/2009 |
| JP | 2010-025037 | A | 2/2010 |
| WO | 95/25879 | A1 | 9/1995 |

OTHER PUBLICATIONS

International Search Report; PCT/JP2011/054689; May 31, 2011.
The extended European search report issued by the European Patent Office on Oct. 26, 2016, which corresponds lo European Patent Application No. 11759152-1607 and is related to U.S. Appl. No. 13/637,396.

* cited by examiner

COMPRESSOR OF USE IN GAS TURBINE ENGINE

TECHNICAL FIELD

The present invention relates to compressor, for ruse in a gas turbine engine, comprising a compressor housing or casing accommodating rotor and stator blade wheels.

BACKGROUND OF THE INVENTION

In the conventional gas turbine engine, an intake air is compressed by the compressor. The compressed air is supplied into combustors where it is combusted with fuel to generate high-temperature and high-pressure combustion gas. The combustion gas is supplied to a turbine where it is used as rotational energy and then discharged into the air.

Typically, the compressor casing, which is made of cast iron, needs anti-corrosion treatment because the rust created on the inner surface of the compressor casing would adhere to the surfaces of the blade wheels to degrade the performance of the compressor. Also, flaked rust may clog a passage for transporting a part of the compressed air to be used in cooling heated components in the turbine and thereby affect respective lifetimes of the components. To cope with this problem, JP 2009-523939 (A) discloses to provide an anti-corrosion coating on surfaces of the compressor casing, exposed to the air passage. According to this technique, the anti-corrosion coating is provided on portions exposed to the air passage between the radially outward flanges of the stator blade wheels mounted on the inner surfaces of the compressor casing and the seal rings (shrouds) opposing the radially outward ends of the rotor blade wheels.

The technique, however, requires the coatings on the inner surface portions of the compressor casing, which increases the manufacturing process and cost of the engine. Instead, no coating will need periodic cleanings of the inner surfaces of the compressor casing, increasing the maintenance cost.

Therefore, an object of the present invention is to provide a compressor for use in the gas turbine engine capable of preventing a creation of rust on the inner surfaces of the compressor casing without any increase of the manufacturing process.

SUMMARY OF THE INVENTION

To this end, a compressor for use in a gas turbine engine according to the invention comprises an outer casing accommodating rotor and stator blade wheels, in which the stator blade wheels are supported at their radially outward ends on an inner circumferential surface of the outer casing through flanges, seal rings are provided at portions of the inner circumferential surface of the outer casing, opposing radial ends of the rotor blade wheels, and the inner circumferential surface of the outer casing is covered by the seal rings and the stator blade wheels.

According to this arrangement, the seal rings and the outer flanges of the stator blade wheels covering the inner surface of the outer casing prevent the inner surface from being exposed to the compressed air and the resultant corrosion thereof which would otherwise be caused by the contact with the compressed air. This also prevents generation of the rust which would adhere to the rotor assemblies to result in a decrease of performance of the compressor and/or a clogging of the cooling air passage to the turbine and thereby shortening of the lifetimes of turbine components. Also, the size increases of the flanges and seal rings in the axial direction do not increase the number of components or additional assembling process.

Preferably, the stator blade wheels are supported by the outer casing as they are spring-forced radially inwardly by leaf springs. According to this arrangement, the leaf springs provide large spring forces.

Preferably, the rotor and stator blade wheels are alternately arranged in the axial direction, and wherein a length of one seal ring in the axial direction differs from that of another seal ring. According to this arrangement, because the dimensions of respective seal rings differ from another, an erroneous assembling is well prevented, which in turn simplifies the assembling of the compressor.

Preferably, the rotor and stator blade wheels are alternately arranged in the axial direction, and wherein a length of one seal ring in the axial direction differs from that of another seal ring. According to this arrangement, because the dimensions of respective flanges differ from another, an erroneous assembling is well prevented, which in turn simplifies the assembling of the compressor.

In conclusion, the inner circumferential surface of the outer casing is covered by the seal rings and the flanges of the stator blade wheels. This prevents the inner circumferential surface from being exposed to the compressed air, which also prevents a corrosion of the inner surface of the outer casing. This also prevents unwanted creation of rust and the resultant adhesion of flaked rusts on the rotor blade wheels which may cause a performance deterioration of the compressor and a clogging of the cooling air passage to the turbine which may cause induce life-span shortening of the turbine components. Further, it is not necessary to increase the number of components or complicate assembling process.

BRIEF DESCRIPTIONS OF THE DRAWINGS

PREFERRED EMBODIMENT OF THE INVENTION

Figure 1:
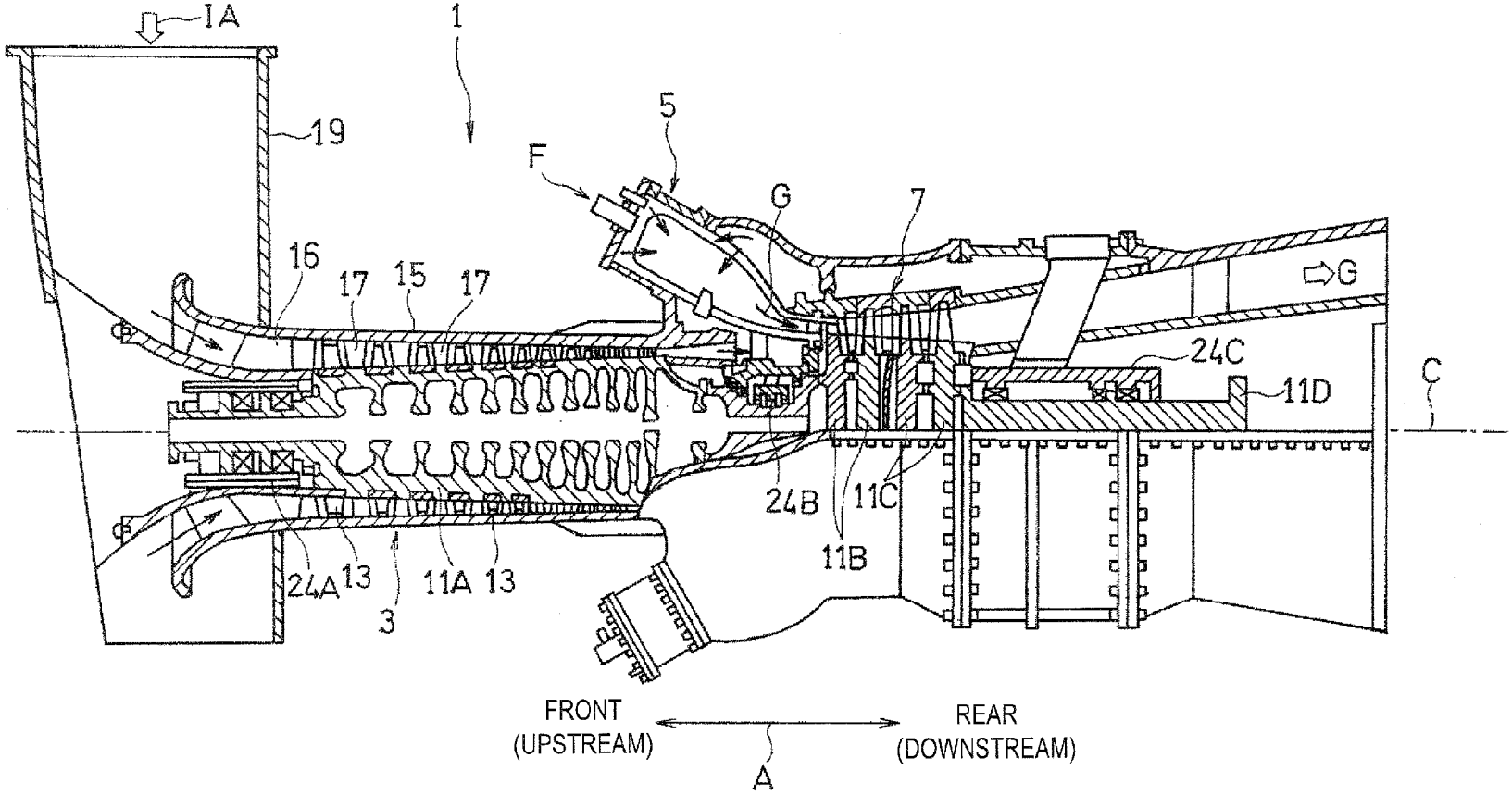
FIG. 1 is a partial longitudinal cross section of a gas turbine engine comprising a compressor according to a first embodiment of the invention.

With reference to the accompanying drawings, a preferred embodiment according to the invention will be described below. FIG. 1 shows a gas turbine engine generally indicated at 1 in which a compressor 3 compresses an intake air IA from the atmosphere to generate a compressed air. The compressed air is supplied into combustors 5 where it is combusted with fuel ejected into the combustors 5 to generate high-temperature and high-pressure combustion gas G. The combustion gas G is used for driving a turbine 7. In the following descriptions, one side adjacent the compressor 3 is referred to as "front" or "upstream" side and the opposite side adjacent the turbine 7 is referred to as "rear" or "downstream" side as necessary.

In this embodiment, the compressor 3 is an axial compressor and comprises rotor blade wheels 13 provided on an outer peripheral surface of the compressor rotor 11A which constitutes a front rotational portion of the gas turbine engine 1 and stator blade wheels 17 provided on an inner peripheral surface of the compressor housing or outer casing 15. The rotor and stator blade wheels 13 and 17 are disposed alternately in the axial or longitudinal direction so that the intake air IA is compressed by the cooperation of the rotor and stator blade wheels 13 and 17. Specifically, the rotor and stator blade wheels 13 and 17 are positioned for guiding the compressed air in a passage 16 defined between the outer casing 15 and the compressor rotor 11A. A cross section area of the compressed air passage 16 decreases as it advances downward.

The compressor rotor 11A is connected to a high-pressure turbine rotor 11B of the turbine 7. A low-pressure turbine rotor 11C is mounted on the rear side of the high-pressure turbine rotor 11B. The compressor rotor 11A is supported for rotation by the front bearing 24A and the central bearing 24B. The low-pressure turbine rotor 11C is supported through the turbine shaft 11D connected to its rear end by the rear bearing 24C.

Figure 2:
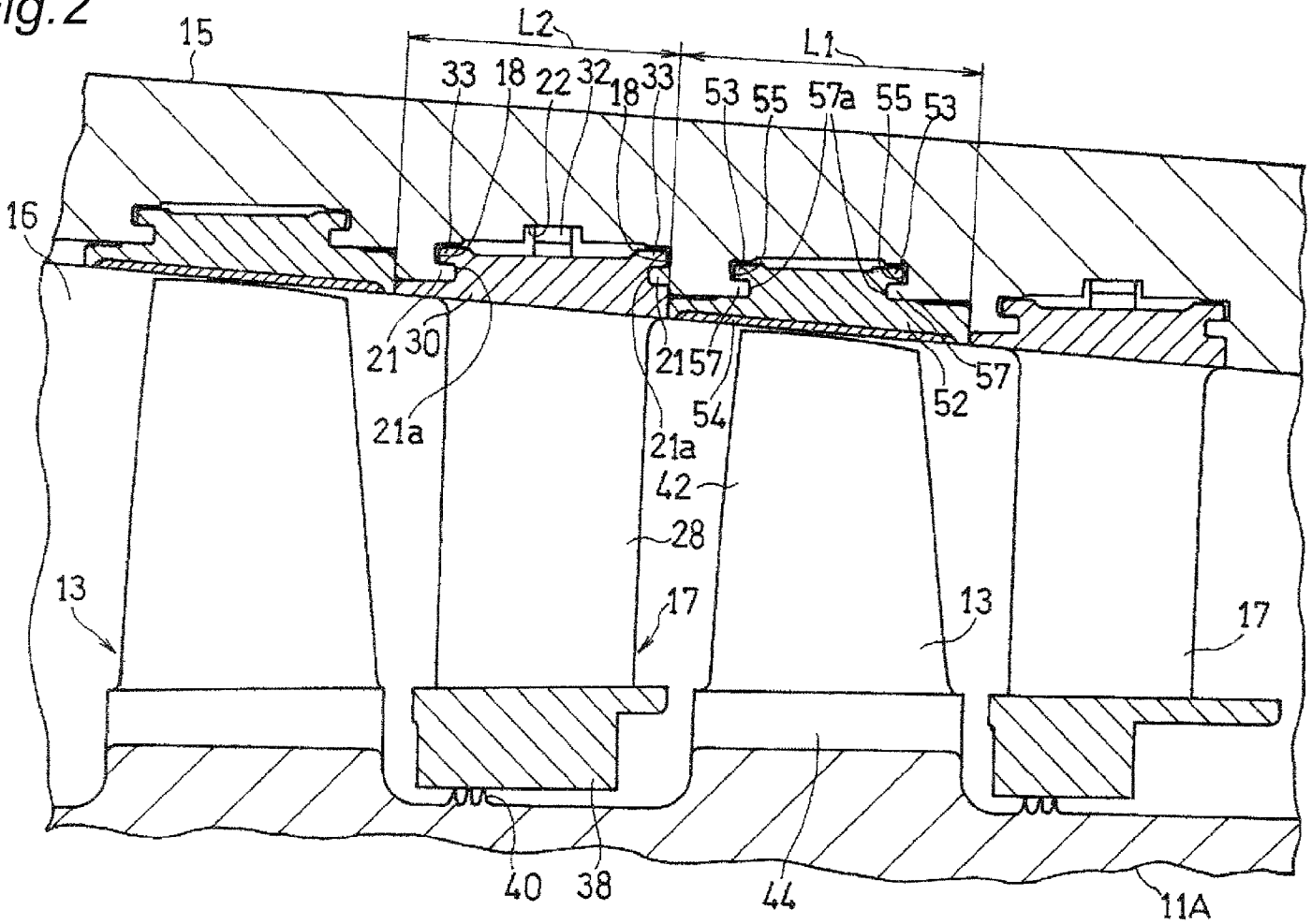
FIG. 2 is an enlarged partial longitudinal cross section of the compressor in FIG. 1.

As shown in FIG. 2, the outer casing 15 of the compressor 3, which is made of carbon steel, surrounds the rotor blade wheel 13 and the stator blade wheel 17. The rotor and stator blade wheels 13 and 17 are also made of carbon steel and their surfaces are coated with an anti-corrosion paint.

The stator blade wheel 17 has a number of stator blades 28 provided within the compressed-air passage 16 for guiding the compressed air and is supported on the associated inner surface portion of the outer casing 15 by outer flanges 30 defined at the radially outward end of the stator blades 28. Each of the outer flanges 30 has a pair of front and rear projections or engagement portions 33 integrally defined at the front and rear ends of the flange 30, respectively. This allows that the stator blades 28 are supported by the outer casing 15 with the front and rear engagement portions 33 engaged in associated front and rear engagement grooves 18 formed in the outer casing 15. A leaf spring 32, in the form of arch when viewed in the axial direction, is provided between the outer flange 30 and opposing groove 22 defined in the inner circumferential surface of the outer casing 15 so that the engagement portions 33 of each stator blade 28 are supported as radially-inward circumferential surfaces of the engagement portions 33 are forced against the opposing radially-outward circumferential surfaces of the first flanges 21 partially defining the engagement grooves 18.

Each of the stator blades 17 comprises an inner segment portion 38 integrally formed therewith. A labyrinth seal 40 is provided between inner circumferential surface of the segment portion 38 and outer circumferential surface portion of the opposed compressor rotor 11A. The inner segment 38 is also made of carbon steel and its surface is coated with the anti-corrosion paint.

The rotor blade wheel 13 comprises a number of rotor blades 42 positioned within the compressed-air passage 16. Each of the stator blades 42 comprises a stator flange 44 at its radially inward end integrally formed therewith and is supported on the outer surface of the compressor rotor 11A with the flange 44 engaged with associated outer portion of the compressor rotor 11A.

The outer casing 15 supports seal rings or shrouds 52 so that each seal ring opposes radially outward end of the associated rotor blade wheel 13 and positions between the axially neighboring outer flanges 30 with its front and rear end substantially in contact with the front and rear outer flanges 30 but leaving significantly small gaps between its front and rear ends and the opposing rear and front ends of the axially neighboring outer flanges 30. This results in that the inner surface of the outer casing 15 is substantially covered by the seal rings 52 and the outer flanges 30.

Each of the seal rings 52 comprises a pair of axially-projecting front and rear circumferentially-extending engagement portions or projections 53 integrally formed therewith so that they can engage with associated front and rear circumferentially-extending grooves 55 defined in the inner casing 15 to support seal rings 52 by the outer casing 15. Provided in the outer casing 15, inwardly adjacent the front and rear grooves 55 are axially-projecting and front and rear circumferentially-extending second flanges 57. The inner surface portions of the seal rings 52, opposing the radially outward ends of the rotor blade wheel 13, support abladable coatings 54. The coatings 54 are made of material milder than that of the rotor blade wheel 13.

An axial length L1 of the seal rings 52, in particular, measured on the inner surface thereof exposed to the compressed-air passage 16, in each stage constituted by the neighboring rotor and stator blade wheels is determined to be different from that in another stage constituted by another neighboring rotor and stator blade wheels. Likewise, an axial length L2 of the outer flange 30, in particular, measured on the inner surface thereof exposed to the compressed-air passage 16, in each stage constituted by the neighboring rotor and stator blade wheels is determined to be different from that in another stage constituted by another neighboring rotor and stator blade wheels. As such, because the axial lengths L1 and L2 in one stage differ from those of the other stages, the seal rings 52 and the stator blades 17 are effectively assembled in their right places of the outer casing 15. Instead, the same advantages can be obtained by varying the axial length between the opposing ends 57*a* of the front and rear second flanges 57 in one stage from those of the other stages even if the axial length L1 of the seal ring 52 in one stage is the same as those of the other stages and/or by varying the axial length between the opposing ends 21*a* of the front and rear first flanges 21 in one stage from those of the other stages even if the axial length L2 of the outer flange 52 in one stage is the same as those of the other stages.

Figure 3:
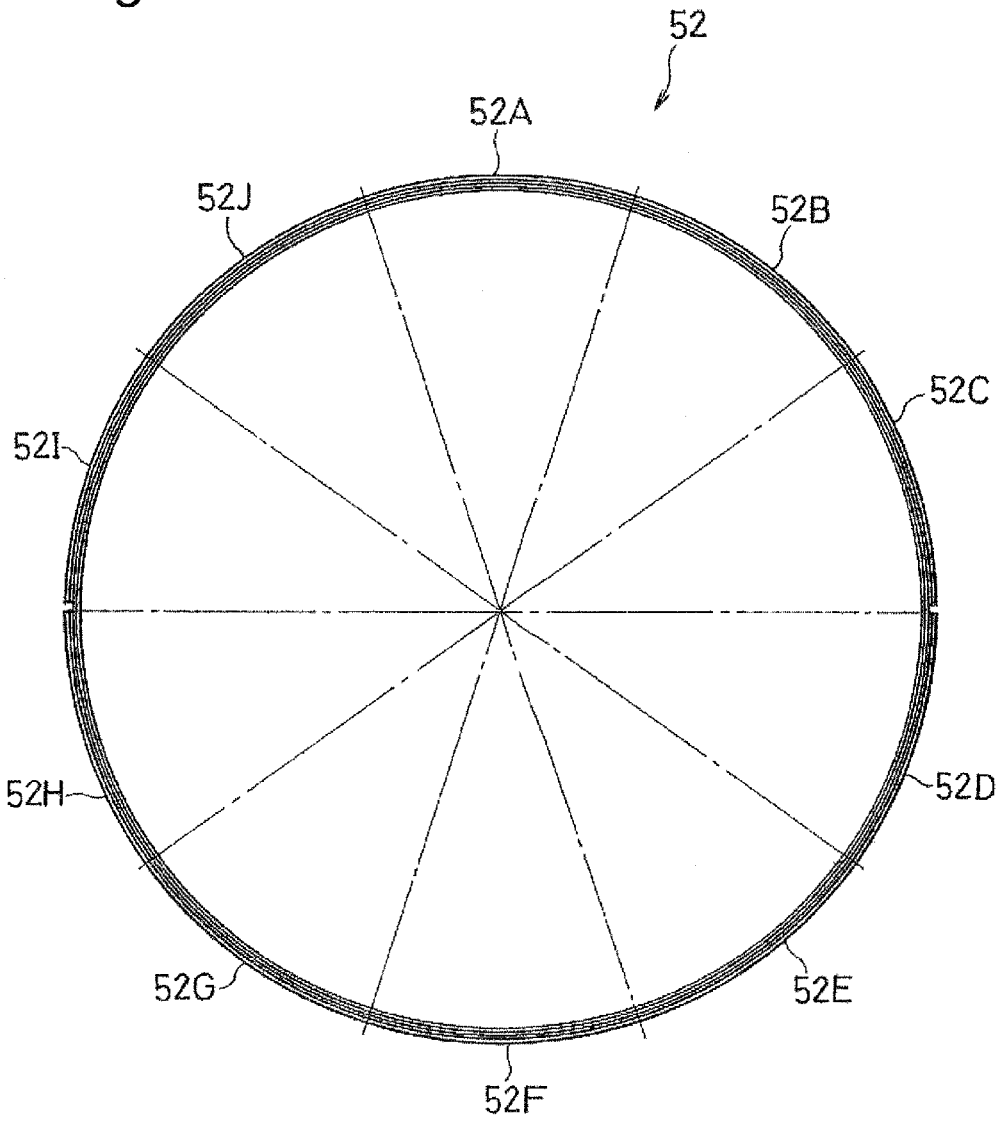
FIG. 3 is a front view of a seal ring of the compressor in FIG. 1.

The outer casing 15 is made of two half-ring pieces. Each of the seal rings 52 and each of the stator blade wheels 17 are made of a number of circumferentially divided parts or segments. In this embodiment, as shown in FIG. 3 the seal ring 52 is divided into ten segments 52A-52J, for example.

Figure 4A:
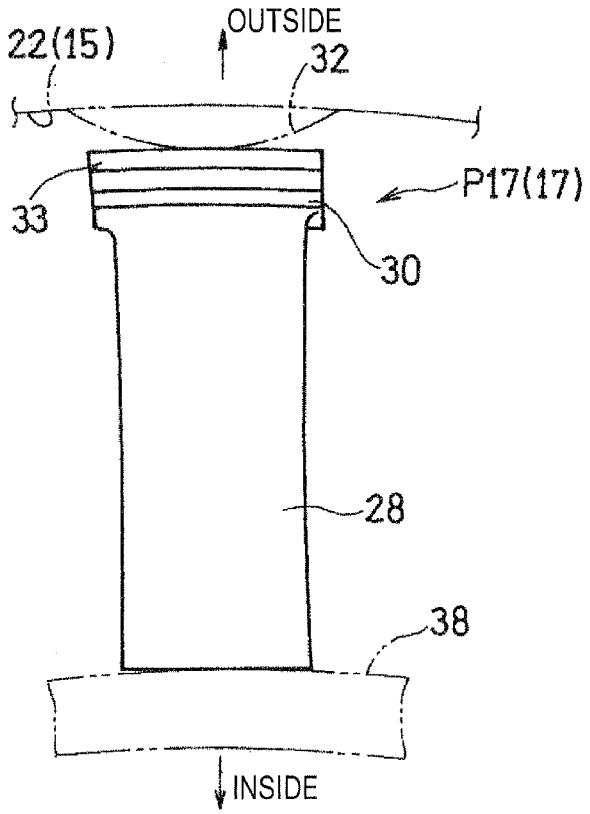
FIG. 4A is a front view of the first-stage stator of the compressor in FIG. 1.
Figure 4B:
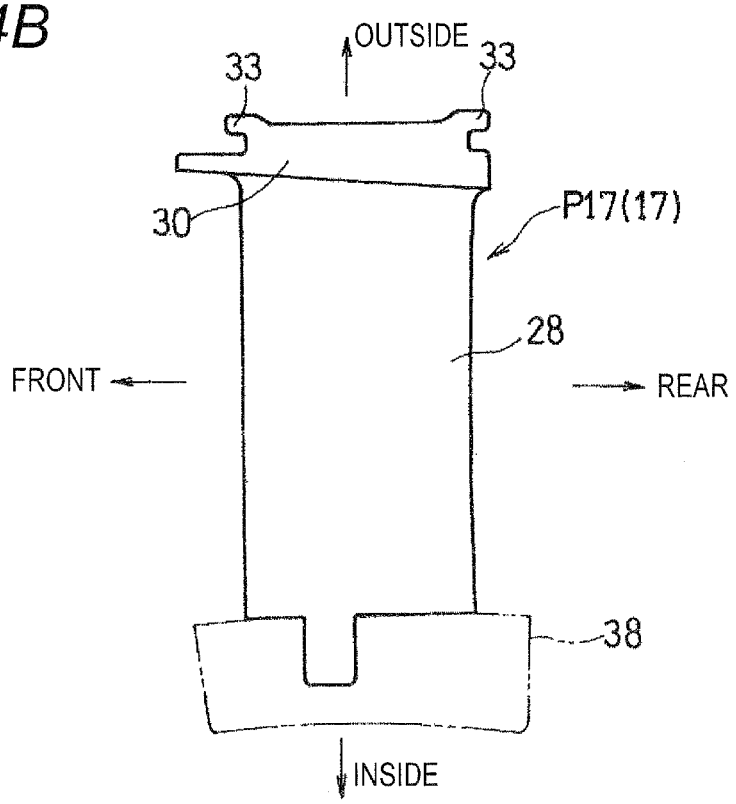
FIG. 4B is a side elevational view of the first-stage stator of the compressor in FIG. 1.

FIGS. 4A and 4B are the front and side views of a piece of stator blade 17P. As shown in the drawings, the front and rear engagement portions 33 of the outer flange 30 extend the entire circumferential length of the piece P17. Also, the piece P17 is forced radially inwardly by the associated leaf spring 32 mounted between the outer flange 30 and the groove 22 for receiving the spring 32. As shown in the drawing, the leaf spring 32, in the form of arch, is provided for each piece P17 with its central portion and opposite end portions oriented inward and outward, respectively. Although as shown in FIG. 4B the outer flange 30 of the stator blade is extended forwardly so that it extends beyond the front end of the blade portion, it may be extended rearwardly instead. The inner support ring 38 is divided into a plurality of ring segments and each segment is provided for each piece P17.

When assembling the seal rings 52 and the stator assemblies 17 into the outer casing 15, the divided ring pieces 52A-52J of each seal ring 52 and the pieces P17 of the stator assemblies 17 are mounted to respective half-ring pieces of the outer casing 15. In this process, the engagement portions 53 of the seal rings 52 and engagement portions 33 of the stator pieces P17 are slidingly engaged in the circumferentially extending engagement grooves 55 and 18 of the outer casing 15, respectively. Also, the leaf springs 32 are mounted in places. Then, the two half-rings of the outer casing 15 are assembled together.

According to the arrangement described above, the seal rings 52 and the outer flanges 30 of the stator blade wheels 17 covering the inner surface of the outer casing 15 prevent the inner surface from being exposed to the compressed air and the resultant corrosion thereof which would otherwise be caused by the contact with the compressed air. This also prevents generation of the rust which would adhere to the rotor assemblies 13 to result in a decrease of performance of the compressor and/or a clogging of the cooling air passage to the turbine 7 and thereby shortening of the lifetimes of turbine components. Also, the size increases of the flanges 30 and seal rings 52 in the axial direction do not increase the number of components or additional assembling process. Further, the outer casing 15 does not define any part of the compressed-air passage, which does not need any strict size tolerance for the outer casing 15 and therefore the outer casing 15 can be manufactured or machined readily and economically.

Besides, the stator assembly 17 is supported by the outer casing 15 as the engagement portions 33 are forced radially inwardly by the leaf springs 32 against the associated portions of the outer casing 15. The leaf spring 32 can create larger force than the conventional cylindrical spring having a C-shape cross section, which ensures the stator assembly 17 to be supported by the outer casing 15 in a stable manner.

Also, the axial length L1 of the seal ring and the axial length L2 of the outer flange 30 in each stage differ from those in the other stages, which prevents the seal ring 52 or the stator assembly 17 in one stage from being mounted in another stage accidentally and therefore improves the assembling thereof.

Although preferred embodiments of the invention have been described with reference to the accompanying drawings, various modifications can be made without departing from the gist of the invention and they are within the scope of the invention.

PARTS LIST

3: compressor
13: rotor blade wheel
15: outer casing (housing)
17: stator assembly
32: leaf spring
52: seal ring

The invention claimed is:

1. A compressor for use in a gas turbine engine, comprising:

a cylindrical casing having a longitudinal axis and an inner circumferential surface about the longitudinal axis;

a plurality of rotor blade wheels mounted within the casing for rotation about the longitudinal axis, each of the rotor blade wheels having a number of rotor blades positioned at intervals in a circumferential direction about the longitudinal axis;

a plurality of stator blade wheels unrotatably mounted within the casing, each of the stator blade wheels having a number of stator blades positioned at intervals in the circumferential direction about the longitudinal axis, the stator blades each having a flange defined therewith at radially outward ends thereof by which the stator blades are supported on the circumferential surface of the casing, the rotor and stator blade wheels being positioned alternately in an axial direction parallel to the longitudinal axis;

seal rings positioned on the inner circumferential surface of the casing to oppose radially outward ends of the rotor blades, the seal rings each having a flange defined therewith;

the casing having a plurality pairs of opposing circumferentially extending engagement grooves defined in the inner circumferential surface thereof and the seal rings each having a pair of complementary circumferentially extending engagement projections, so that the seal rings are supported on the inner circumferential surface of the casing by engaging each pair of engagement projections with the associated each pair of engagement grooves, the flanges of the stator blades and the seal rings being shaped and sized so that neighborhood flanges of a neighborhood stator blade and the seal ring in the axial direction are substantially in contact with each other in the axial direction such that the flanges of the stator blades and the seal rings are supported on the inner circumferential surface of the casing, a length of the seal ring in the axial direction and/or a distance between the pair of engagement projections of the seal ring in one rotor blade wheel in the axial direction being different from that in another rotor blade wheel, the compressor further comprising springs provided between the flanges of the stator blades and the circumferential surface of the casing to thereby force the stator blades radially inwardly so that the stator blades are supported in a stable manner, wherein each of the springs is made of a leaf spring and is positioned in the form of an arch when viewed in the axial direction so that opposite ends of the leaf spring are supported by the casing and a central portion of the leaf spring is forced on an outer periphery of the stator blade.

2. The compressor of claim 1, wherein the flanges of the stator blades each have a pair of circumferentially extending engagement projections, and the casing having a plurality pairs of circumferentially extending engagement grooves defined in the inner circumferential surface thereof, so that the flanges of the stator blades are supported on the inner circumferential surface of the casing by engaging each pair of engagement projections of the flanges of the stator blades with the associated each pair of engagement grooves of the casing, a length of the flanges of the stator blades in the axial direction and/or a distance between the pair of engagement projections of the flanges of the stator blades in one stator blade wheel in the axial direction being different from that in another stator blade wheel.

3. The compressor of claim 1, wherein the cylindrical casing has a circumferential groove between the engagement grooves and the springs are received between the flanges and the circumferential groove.

4. A compressor for use in a gas turbine engine, comprising:

a cylindrical casing having a longitudinal axis and an inner circumferential surface about the longitudinal axis;

a plurality of rotor blade wheels mounted within the casing for rotation about the longitudinal axis, each of the rotor blade wheels having a number of rotor blades positioned at intervals in a circumferential direction about the longitudinal axis;

a plurality of stator blade wheels unrotatably mounted within the casing, each of the stator blade wheels having a number of stator blades positioned at intervals in the circumferential direction about the longitudinal axis, the stator blades each having a flange defined therewith at radially outward ends thereof by which the stator blades are supported on the circumferential surface of the casing, the rotor and stator blade wheels being positioned alternately in an axial direction parallel to the longitudinal axis;

seal rings positioned on the inner circumferential surface of the casing to oppose radially outward ends of the rotor blades, the seal rings each having a flange defined therewith, the casing having a plurality pairs of circumferentially extending engagement grooves defined in the inner circumferential surface thereof and each pair of flanges having a pair of complementary circumferentially extending engagement projections, so that the flanges are supported on the inner circumferential surface of the casing by engaging each pair of engagement projections with the associated each pair of engagement grooves, the flanges of the stator blades and the seal rings being shaped and sized so that neighborhood flanges of a neighborhood stator blade and the seal ring in the axial direction are substantially in contact with each other in the axial direction such that the flanges of the stator blades and the seal rings are supported on the inner circumferential surface of the casing, a length of the flanges of the seal ring and/or a distance between the pair of engagement projections of the flanges of the seal ring in one stator blade wheel in the axial direction being different from that in another stator blade wheel, the compressor further comprising springs provided between the flanges of the stator blades and the circumferential surface of the casing to thereby force the stator blades radially inwardly so that the stator blades are supported in a stable manner, wherein each of the springs is made of a leaf spring and is positioned in the form of an arch when viewed in the axial direction so that opposite ends of the leaf spring are supported by the casing and a central portion of the leaf spring is forced on an outer periphery of the stator blade.

5. The compressor of claim 4, wherein the cylindrical casing has a circumferential groove between the engagement grooves and the springs are received between the flanges and the circumferential groove.

* * * * *